US012195926B2

(12) United States Patent
Philipp et al.

(10) Patent No.: US 12,195,926 B2
(45) Date of Patent: Jan. 14, 2025

(54) METHOD AND DEVICE FOR CONSOLIDATING A BALLAST BED

(71) Applicant: PLASSER & THEURER EXPORT VON BAHNBAUMASCHINEN GMBH, Vienna (AT)

(72) Inventors: Thomas Philipp, Leonding (AT); Harald Daxberger, Linz (AT); Florian Auer, Vienna (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 926 days.

(21) Appl. No.: 17/288,638

(22) PCT Filed: Sep. 25, 2019

(86) PCT No.: PCT/EP2019/075779
§ 371 (c)(1),
(2) Date: Apr. 26, 2021

(87) PCT Pub. No.: WO2020/083596
PCT Pub. Date: Apr. 30, 2020

(65) Prior Publication Data

US 2021/0395953 A1 Dec. 23, 2021

(30) Foreign Application Priority Data

Oct. 24, 2018 (AT) ..... A 329/2018

(51) Int. Cl.
*E01B 27/20* (2006.01)
*E01B 27/16* (2006.01)
*E01B 27/17* (2006.01)

(52) U.S. Cl.
CPC ..... *E01B 27/20* (2013.01); *E01B 27/16* (2013.01); *E01B 27/17* (2013.01)

(58) Field of Classification Search
CPC ..... E01B 27/00; E01B 27/028; E01B 27/16; E01B 27/17; E01B 27/20; E01B 35/00;
(Continued)

(56) References Cited

U.S. PATENT DOCUMENTS 4,046,079 A 9/1977 Theurer
4,563,953 A 1/1986 Theurer
(Continued)

FOREIGN PATENT DOCUMENTS

AT 520056 A1 12/2018
CN 1766231 A 5/2006
(Continued)

*Primary Examiner* — Zachary L Kuhfuss
*Assistant Examiner* — Heaven R Buffington
(74) *Attorney, Agent, or Firm* — Laurence A. Greenberg; Werner H. Stemer; Ralph E. Locher

(57) ABSTRACT

A method for compacting a ballast bed, on which railroad ties and track rails secured thereto are supported, uses a work assembly which is arranged on a track construction machine that can be moved on the track. During a compaction process, a signal is detected and a characteristic variable is derived therefrom by an analysis device in order to evaluate the quality of the ballast bed. The work assembly contains an electric drive, by which the compaction process is at least partly carried out. At least one operating variable of the electric drive is supplied to the analysis device, and a ballast bed characteristic variable is derived from the operating variable by the analysis device.

13 Claims, 1 Drawing Sheet

(58) Field of Classification Search
CPC .. E01B 35/12; E01B 2203/04; E01B 2203/10; E01B 2203/12; E01B 2203/122; E01B 2203/127
See application file for complete search history.

(56) References Cited

U.S. PATENT DOCUMENTS

| | | | | |
|---|---|---|---|---|
| 9,957,668 | B2 | 5/2018 | Lichtberger | |
| 9,982,396 | B2 | 5/2018 | Lichtberger et al. | |
| 10,780,898 | B2 | 9/2020 | Greindl | |
| 10,914,040 | B2 | 2/2021 | Hofstaetter et al. | |
| 2006/0090666 | A1 | 5/2006 | Theurer et al. | |
| 2017/0019012 | A1* | 1/2017 | Sami | H02K 33/00 |
| 2019/0137356 | A1 | 5/2019 | Philipp | |
| 2020/0181850 | A1 | 6/2020 | Kopf et al. | |
| 2020/0370248 | A1 | 11/2020 | Maier et al. | |

FOREIGN PATENT DOCUMENTS

| | | | | |
|---|---|---|---|---|
| CN | 101358439 | A | 2/2009 | |
| CN | 102031734 | A | 4/2011 | |
| CN | 104818656 | A | 8/2015 | |
| CN | 205557207 | U | 9/2016 | |
| CN | 108603345 | A | 9/2018 | |
| DE | 2557850 | A1 | 8/1976 | |
| EP | 2770108 | A1 | 8/2014 | |
| EP | 3239398 | A1 | 11/2017 | |
| GB | 130121 | A | 7/1919 | |
| GB | 2130626 | A | 6/1984 | |
| GB | 2451310 | A | 1/2009 | |
| IN | 108026704 | A | 5/2018 | |
| JP | H06287904 | A | 10/1994 | |
| RU | 6199 | U1 | 3/1998 | |
| WO | 2017050414 | A1 | 3/2017 | |
| WO | WO-2017129215 | A1 * | 8/2017 | E01B 27/13 |
| WO | 2017202484 | A1 | 11/2017 | |
| WO | 2018219570 | A1 | 12/2018 | |
| WO | 2019110239 | A1 | 6/2019 | |

* cited by examiner

METHOD AND DEVICE FOR CONSOLIDATING A BALLAST BED

BACKGROUND OF THE INVENTION

Field of the Invention

The invention relates to a method for consolidating a ballast bed, on which sleepers and rails fastened thereon of a track are supported, by means of a working unit arranged on a track maintenance machine mobile on the track, wherein a signal is detected during a consolidation procedure and a parameter for evaluation of a quality of the ballast bed is derived from this signal by means of an evaluation device. The invention further relates to a device for implementing the method.

Description of the Related Art

Tracks which have sleepers supported on a ballast bed and rails fastened on the sleepers require recurring maintenance. During this, the track is lifted and lined by means of a track maintenance machine in order to produce an optimal track position. A consolidation of the ballast bed brings about a fixation of this new track position. Likewise, with new construction of a track, a finalizing consolidation of the ballast bed is also required.

For implementing a consolidation procedure, the track maintenance machine includes a working unit or several working units. As a rule, a consolidation by means of a tamping unit takes place immediately following a lifting procedure. During this, tamping tools (tamping tines) penetrate into the ballast bed and, with a combined vibrating- and squeezing motion, consolidate the ballast underneath the sleepers. With this tamping process, a homogenous sleeper support with minimal settlement behaviour is produced.

Subsequently, a further consolidation by means of a stabilizing unit usually takes place. A corresponding track maintenance machine is called a dynamic track stabilizer. In this, the track grid formed of rails and sleepers is joggled into the ballast bed with horizontal vibrations and a vertical load. In this manner, settlements of the track occurring initially after a tamping procedure are anticipated in order to increase the resistance of the track to transverse displacement.

An infrastructure operator responsible for the track maintenance requires information about which loads and how many load cycles the consolidated ballast bed can absorb until the track position needs to be corrected anew. For this reason, methods are applied to determine the characteristics of the ballast bed or its quality during consolidation or after completion of a consolidation procedure.

From Austrian patent application A 223/2017 by the present applicant, for example, a method and a device for consolidating a ballast bed are known. In this, a force-path progression of a tamping tool is recorded during a vibration cycle by means of sensors arranged on a tamping unit. Subsequently, the progression is fed to an evaluation device in order to derive therefrom a parameter for an evaluation of the tamping procedure, or for the quality of the ballast bed.

SUMMARY OF THE INVENTION

It is the object of the invention to simplify a method of the type mentioned at the beginning. In addition, a simplified device for implementing the method shall be indicated.

According to the invention, these objects are achieved by way of the features of the independent claims. Dependent claims indicate advantageous embodiments of the invention.

In this, it is provided that the working unit includes an electric drive by means of which the consolidation procedure is executed at least partially, that at least one operating value of the electric drive is supplied to the evaluation device, and that a ballast bed parameter is derived from the operating value by means of the evaluation device. In this manner, the electric drive itself is used as a sensor to draw conclusion as to the consolidation procedure or the quality of the ballast bed. Thus, the requirement for sensors arranged separately on the working unit is dispensed with. On a treated track section, a continuous assessment of the quality and characteristics of the ballast bed is possible without additional measurement- and experimentation expense. This assessment can take place during the consolidation procedure, so that an immediate corrective intervention is possible, if required.

Advantageously, a mechanical vibration is generated by means of the electric drive which is transmitted via mechanical components of the working unit to the ballast bed. Vibrations introduced into the ballast bed immediately allow conclusions as to the quality of the ballast bed. For example, in the case of a hardened ballast bed, an increased vibration energy must be applied, with correspondingly changed operating values of the electric drive. At least one operating value can thus be used to derive a ballast bed parameter for the quality of the ballast bed.

A further improvement provides that several consolidation procedures are carried out in a cyclic sequence, and that a progression of the ballast bed parameter is derived from a progression of the operating value. With this, local changes of the ballast bed are recognized with a cyclical working process. Further working cycles can thus be adapted to changed conditions, if needed.

For enhancing the precision or for verifying the evaluations it may be useful if, additionally, a measuring value recorded by means of a sensor is supplied to the evaluation device, and if the ballast bed parameter is derived from the operating value and the measuring value. In particular in this, sensors already installed for other purposes may be used.

In a further development of the method according to the invention, a model value is computed from the operating value by means of a digital model of a component or several components of the working unit stored in the evaluation device. In this, the digital model is a static or dynamic model. A degree of detailing chosen when modelling depends on the existing requirements. Often, a simple model is already sufficient to be able to compute a meaningful model value.

Advantageously, by means of an electric motor model stored in the evaluation device, a mechanical model value is derived from an electric operating value, in particular from a current flowing in the electric drive. In this manner, a momentary mechanical condition of the working unit can be used for evaluation of the consolidation procedure.

A useful further development of the method provides that the ballast bed parameter is supplied to a control device, and that the working unit is controlled by means of the control device in dependence on the ballast bed parameter. With this, an automatized work sequence is possible which adapts the consolidation procedure to changed ballast bed conditions without intervention by an operator.

In this, it is advantageous if a control value of the working unit is changed when the ballast bed parameter reaches a pre-set threshold value. This simple measure causes a specifiable adaptation of the consolidation procedure to changed ballast bed conditions.

In a further improvement, the ballast bed parameter is stored in a recording device along with position data of the working unit. In this way, the quality and characteristics of the ballast bed are documented without additional measuring- and experimental expense. With this proof of the consolidation results, corresponding drive clearances for a treated track section can be issued immediately.

The device for implementation of one of the described methods includes a machine frame which is mobile via on-track undercarriages on a track having sleepers supported on a ballast bed and rails fastened thereon. A working unit for consolidating the ballast bed is mounted on the machine frame, wherein an evaluation device is provided for determining a parameter for assessment of a quality of the ballast bed. In this, the working unit includes an electric drive by means of which a consolidation procedure can be executed at least partially, wherein the electric drive is coupled to the evaluation device, and wherein the evaluation device is designed for deriving a ballast bed parameter from an operating value of the electric drive.

In an improved embodiment of the device, a digital model of the electric drive is stored in the evaluation device. With this, various model values can be computed from an operating value or from several operating values.

It is advantageous if the electric drive powers a vibration generator for generating a mechanical vibration. With this, vibrations are introduced into the ballast bed, wherein conclusions as to the quality or characteristics of the ballast bed are drawn from a reaction of the ballast bed to the working unit.

An advantageous variant provides that the working unit is designed as a tamping unit, and that the vibration generator powered by means of the electric drive is coupled via squeezing drives to tamping tools which are lowerable into the ballast bed and squeezable towards one another. Via the tamping tools immersed in the ballast bed, characteristics of the ballast bed have a direct effect on the electric drive. As a result, solid conclusions can be drawn from the operating values of the electric drive as to the conditions in the ballast bed.

In another further development, the working unit is designed as a stabilizing unit, wherein—for transmission of vibrations to the ballast bed—the vibration generator powered by means of the electric drive is coupled to rollers designed to roll on the rails. In this, the rails and sleepers serve as transmission elements, wherein the ballast bed set in vibrations has a reactive effect back on the vibration generator and its drive. In this manner, information about the ballast bed quality can be derived from operating values of the electric drive.

In a further improvement, the device includes a recording device which is coupled to the evaluation device to log a progression of the ballast bed parameter. With this, a continuous evidence of the characteristics of the treated ballast bed is possible.

BRIEF DESCRIPTION OF THE DRAWINGS

The invention will be described below by way of example with reference to the accompanying drawings. There is shown in a schematic manner in:

FIG. 3 a block diagram of the structural elements for determining a ballast bed parameter

DESCRIPTION OF THE EMBODIMENTS

Figure 1:
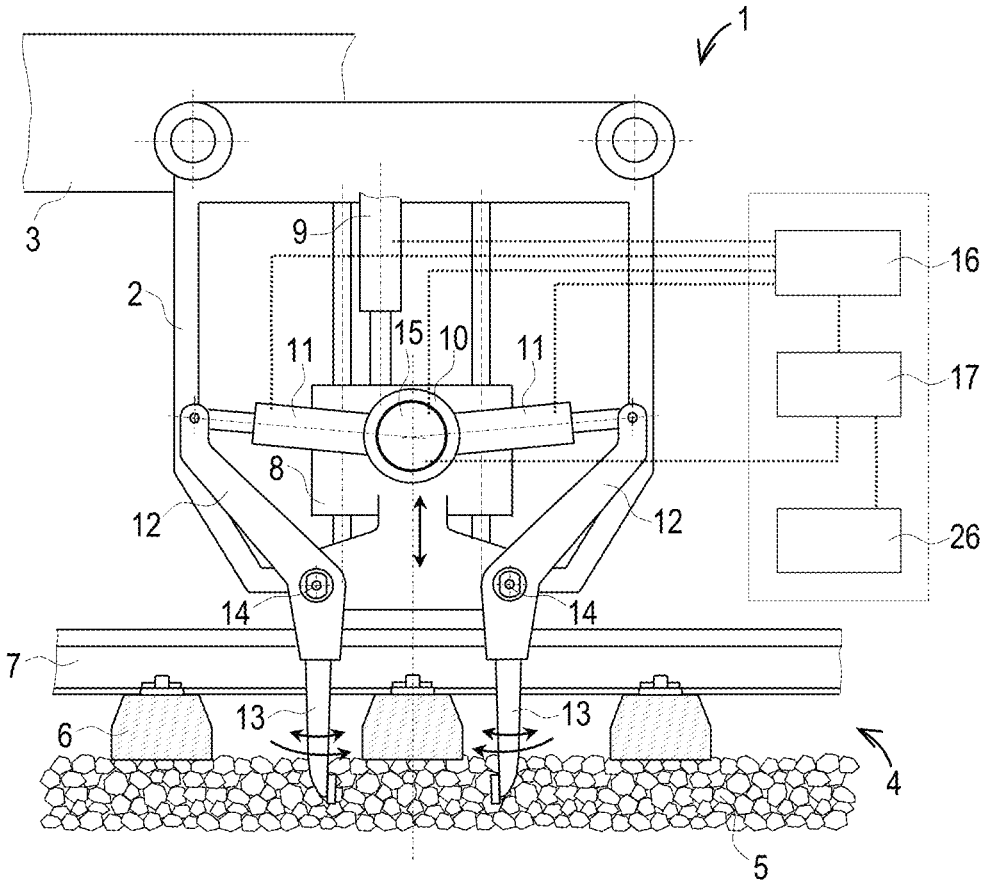
FIG. 1 a tamping unit with electric drive

The working unit shown in FIG. 1 is configured as a tamping unit and includes an assembly frame 2 which is mounted via guides on a machine frame 3 of a track maintenance machine not further described. The working unit 1 serves for treatment of a track 4 having a ballast bed 5 on which sleepers 6 with rails 7 fastened thereon are supported. Specifically, the ballast bed 5 underneath the sleepers 6 is consolidated by means of the working unit 1 designed as a tamping unit. This is carried out in the case of new construction as well as during maintenance of a track 4.

A tool carrier 8 is guided for vertical adjustment in the assembly frame 2, wherein a lowering- or lifting motion takes place by means of an associated vertical adjustment drive 9. Arranged on the tool carrier 8 is a vibration generator 10 to which at least two squeezing drives 11 are connected. Each squeezing drive 11 is connected to a pivot lever 12 of an associated tamping tool 13. Both pivot levers 12 are mounted on the tool carrier 8 for movement towards one another about a respective separate pivot axis 14.

The vibration generator 10 includes, for example, an eccentric shaft rotatable about a rotation axis, wherein the squeezing drives 11 are articulatedly connected to eccentric sections of said shaft. With the eccentric shaft rotating, the attachment points of the squeezing drives which circulate around the rotation axis cause a vibration transmission to the pivot levers 12. In this, the eccentricity, advantageous adjustable, determines the vibration amplitude, and the rotational speed determines the vibration frequency.

A tamping tine is arranged at the free end of each tamping tool 13. For a consolidation procedure, the tamping tools 13—actuated with vibrations—are lowered into the ballast bed 5. Underneath the sleeper lower edge, the tamping tines with their tine plates at the ends are squeezed towards one another by means of the squeezing drives 11 and thus consolidate the ballast support of the sleeper 6.

According to the invention, the working unit 1 includes an electric drive 15 which, in the present example, powers the eccentric shaft. Especially well suited is a torque motor which is flange-connected to an eccenter housing, wherein the eccentric shaft is connected to the rotor of the torque motor. The torque motor is controlled by means of a control device 16. The control device 16 also controls control valves of the hydraulic drives of the working unit 1. In the present example, these are the vertical adjustment drive 9 and the squeezing drives 11.

An evaluation device 17 is coupled to the control device 16. This is, for example, an industrial computer which is designed for receiving and evaluating signals. At least one operating value 18 of the electric drive 15 is supplied to the evaluation device 17. Said operating value 18 is provided either by the control device 16 or directly by the electric drive 15.

During operation of the working unit 1, the electric drive 15 effects the consolidation procedure at least partially, since the consolidation of the ballast bed 5 is influenced significantly by the vibrations of the tamping tools 13. In addition, the consolidation depends on the present condition of the ballast bed 5, i.e. on its quality or its physical characteristics. During this, counter forces of the ballast bed 5 act on the tamping tools 13, as a result of which a reaction of the ballast bed 5 on the electric drive 15 takes place in further sequence.

In this, it is irrelevant that hydraulic components (squeezing drives 11) are situated in the power path between the electric drive 15 and the tamping tools 13. It is only essential that at least one operating value 18 of the electric drive 15 can be used for computing a ballast bed parameter 19.

Figure 2:
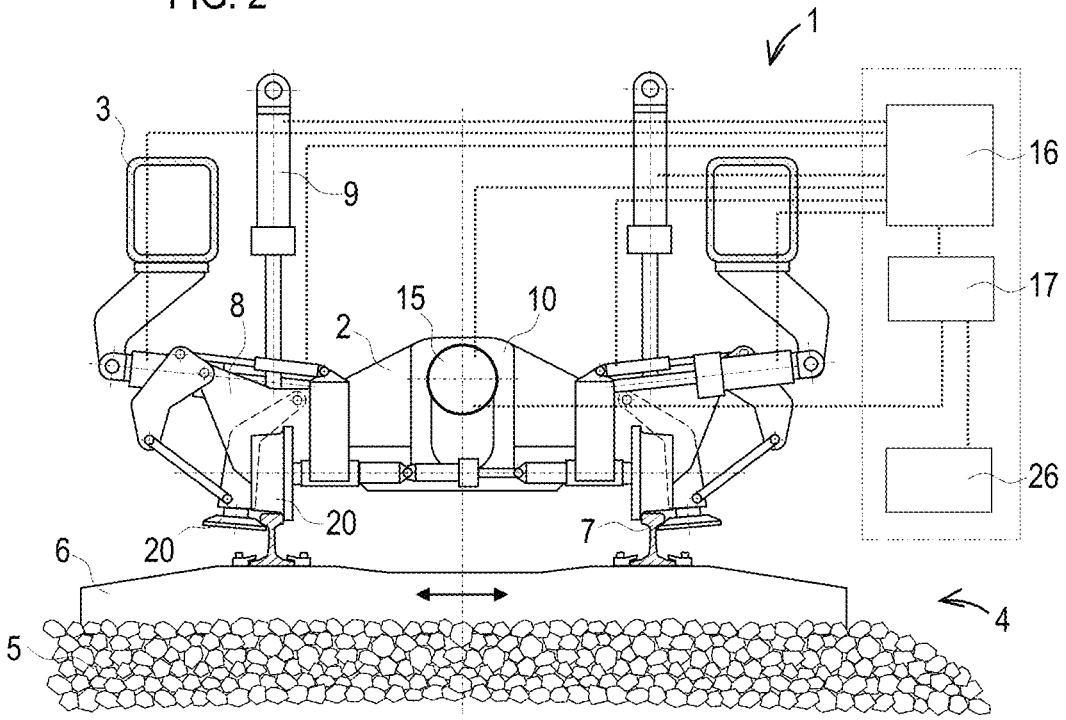
FIG. 2 a stabilizing unit with electric drive

As a further example of a working unit 1, a stabilizing unit is shown in FIG. 2. It is arranged on a machine frame 3 of a track maintenance machine not further described. In working operations, the track grid formed of rails 7 and sleepers 6 is set in vibrations by means of the stabilizing unit. The vibrations are transmitted to the surrounding ballast bed 5, as a result of which the same is consolidated. In this manner, a settling of the track grid is anticipated after a tamping procedure in order to be able to release the track 4 for standard operations right away.

This working unit 1 also includes an electric drive 15 of a vibration generator 10. For example, a shaft with imbalances arranged thereon is powered. The vibrations are transmitted to the track grid by means of rail rollers 20 pressed to the rails 7 and propagate into the ballast bed 5. In this, counter forces react on the track grid, as a result of which there is, in turn, a reaction of the quality and characteristics of the ballast bed 5 back on the electric drive 15. For example, with equal impact force, the vibration amplitude depends on the already present ballast bed consolidation or on the transverse displacement resistance of the ballast bed 5.

For control of the electric drive 15, a suitable control device 16 is present, wherein the same is coupled to the evaluation device 17 for computing at least one ballast bed parameter 19. For a computing procedure 21, at least one operating value 18 of the electric drive 15 is supplied to the evaluation device 17.

An advantageous computing method is described in more detail by way of the block diagram in FIG. 3. At least one digital static or dynamic model 22 of a component of the working unit 1 is stored in a processor or a memory device. For example, a digital model 22 of an electric motor is stored for the electric drive 15. By means of the digital model 22, a model value 23 is computed from an operating value 18.

Operating values 18 are, for example, an electric current, an electric voltage, a duty cycle, a magnetic potential difference, a magnetic penetration, a magnetic field strength, a magnetic flux, or a magnetic flux density. Model values derived from this are, for example, a moment, a force, a speed or angular speed, or an acceleration or angular acceleration. In the case of an electric drive 15 of a hydraulic pump, it is also possible to compute a pressure or a volume stream as a model value.

Specifically, a moment of the electric drive 15 can be computed from a rotary angle of the rotor and the measured currents with the aid of the digital motor model 22. Furthermore, those forces acting directly on the ballast bed 5 can be computed from a speed or angular speed as well as from a driving force or a driving moment of the electric drive 15 with use of a mechanical model of the working unit 1. From this, while taking account of the known dynamic forces, the forces reacting by the ballast bed 5 back on the working unit 1 ensue, which serve for deriving the ballast bed parameter 19.

The computation of the model values 23 can take place in components provided especially for this, in the control device 16 or the evaluation device 17, or in components provided for other tasks (for example, computation of the motor moment in the power electronics of the motor).

In the simplest case, a ballast bed parameter 19 is derived from only one operating value 18 of the electric drive 15 by way of the computation procedure 21. To better evaluate the quality and the characteristics of the ballast bed 5, however, it is advantageous if several model values 23 are used. The execution of the computation procedure 21 takes place by means of a processor. To that end, a computation software is installed in the processor which computes, on the basis of parameters of the working unit 1 and the track 4 as well as specific computing specifications, a parameter 19 from the input variables 18, 23.

An improvement of the computing procedure 21 is attained by taking into account measuring values 24. The measuring values 24 are provided, for example, by a sensor or electronic technology 25 installed at the working unit 1. For logical reasons, sensors and electric components already provided for other purposes are used. In addition, an operating value 18 can also be present as measuring value 24 if the electric drive 15 comprises a suitable sensor technology. For example, operating values 18 or model values 23 of the electric drive 15 and measuring values 24 are used to determine from this mechanical model values 23 of the working unit 1.

The result of the computing process 21 is at least one ballast bed parameter 19 which serves for assessing the quality or the characteristics of the ballast bed 5. For example, a parameter 19 is determined from the progression of a model value 23 or several model values 23 (speed progression, force progression, pressure progression . . . ) of the working unit 1. Specifically, an energy consumption, extreme values of the forces and stiffnesses derived form a force-position progression can be formed as ballast bed parameters 19.

For documentation of the track treatment, the evaluation device 17 is coupled to a recording device 26. Advantageously, a momentary position of the working unit 1 is continuously reported to the recording device 26. Thus, a progression of the found ballast bed parameters 19 is stored in a location-dependent way.

The invention claimed is:

1. A method for consolidating a ballast bed, on which railroad ties and rails, fastened thereto of a track are supported, by means of a working unit disposed on a track maintenance machine mobile on the track, which comprises the steps of:

detecting a signal during a consolidation procedure executed at least partially by the working unit having an electric drive; and deriving a ballast bed parameter for evaluation of a quality of the ballast bed from the signal by means of an evaluation device, at least one operating value of the electric drive being supplied to the evaluation device, using the at least one operating value for computing a model value by means of a digital model of a component or several components of the working unit stored in the evaluation device, wherein by means of an electric motor model stored in the evaluation device, a mechanical model value is derived from the at least one operating value being an electric operating value, and that the ballast bed parameter is derived from the at least one operating value by means of the evaluation device.

2. The method according to claim 1, which further comprises generating a mechanical vibration by means of the electric drive which is transmitted via mechanical components of the working unit to the ballast bed.

3. The method according to claim 1, which further comprises carrying out several consolidation procedures in a cyclic sequence, and that a progression of the ballast bed parameter is derived from a progression of the at least one operating value.

4. The method according to claim 1, which further comprises additionally supplying a measuring value recorded by means of a sensor to the evaluation device, and that the ballast bed parameter is derived from the at least one operating value and the measuring value.

5. The method according to claim 1, which further comprises supplying the ballast bed parameter to a controller, and the working unit is controlled by means of the controller in dependence on the ballast bed parameter.

6. The method according to claim 5, which further comprises changing a control value of the working unit when the ballast bed parameter reaches a pre-set threshold value.

7. The method according to claim 1, which further comprises storing the ballast bed parameter in a recording device along with position data of the working unit.

8. The method according to claim 1, wherein the electric operating value is a current flowing in the electric drive.

9. A device, comprising:

a machine frame having on-track undercarriages and being mobile via said on-track undercarriages being on a track having railroad ties supported on a ballast bed and rails fastened thereon;

a working unit mounted on said machine frame for consolidating the ballast bed, said working unit having an electric drive by means of which a consolidation procedure can be executed at least partially; and an evaluation device for determining a ballast bed parameter for assessment of a quality of the ballast bed, said evaluation device coupled to said electric drive, and said evaluation device being configured for deriving the ballast bed parameter from an operating value of said electric drive supplied to the evaluation device, said evaluation device using the operating value for computing a model value by means of a digital model of a component or several components of said working unit stored in said evaluation device, wherein by means of an electric motor model stored in said evaluation device, a mechanical model value is derived from the at least one operating value being an electric operating value.

10. The device according to claim 9, wherein said working unit has a vibration generator, said electric drive powers said vibration generator for generating a mechanical vibration.

11. The device according to claim 10, wherein said working unit is a tamping unit further having squeezing drives and tamping tools, said vibration generator powered by means of said electric drive is coupled via said squeezing drives to said tamping tools which are lowerable into the ballast bed and squeezable towards one another.

12. The device according to claim 10, wherein said working unit is configured as a stabilizing unit having rollers, and for transmission of vibrations to the ballast bed, said vibration generator powered by means of said electric drive is coupled to said rollers configured to roll on the rails.

13. The device according to claim 9, further comprising a recording device being coupled to said evaluation device to log a progression of the ballast bed parameter.

* * * * *